United States Patent [19]

Norris

[11] Patent Number: 4,565,050

[45] Date of Patent: Jan. 21, 1986

[54] CASE CLOSING APPARATUS

[75] Inventor: Charles R. Norris, Vista, Calif.

[73] Assignee: Weyerhaeuser Company, Tacoma, Wash.

[21] Appl. No.: 676,768

[22] Filed: Nov. 30, 1984

[51] Int. Cl.[4] ..... B65B 7/20

[52] U.S. Cl. ..... 53/491; 53/374; 53/381 R; 53/383; 53/525

[58] Field of Search ..... 53/242, 374, 381 R, 53/383, 484, 491, 525

[56] References Cited

U.S. PATENT DOCUMENTS

| | | | |
|---|---|---|---|
| 3,475,877 | 11/1969 | Fuller et al. . | |
| 3,587,209 | 6/1971 | Arentz | 53/374 |
| 3,590,551 | 7/1971 | Riddington . | |
| 3,613,330 | 10/1971 | Voullaire . | |
| 3,935,798 | 2/1976 | Paxton . | |
| 4,010,597 | 3/1977 | Nelson | 53/374 |
| 4,386,491 | 6/1983 | Cramer et al. | 53/247 |

FOREIGN PATENT DOCUMENTS 3143093 5/1983 Fed. Rep. of Germany .

*Primary Examiner*—John Sipos
*Assistant Examiner*—Donald R. Studebaker

[57] ABSTRACT

Placing a lay-flat container body into a lay-flat container lid, opening the container, closing the top closure panels and leaving the bottom closure panels open, thereafter placing a product into the container, raising the container body until the bottom closure panels clear the product, closing the inner bottom closure panels, placing adhesive on the bottom panels, closing the outer bottom closure panels, adhering the bottom closure flaps to each other and vibrating the container to force the container body down into the container lid. The apparatus has a filler, a pair of clamps that grasp and lift the container body upwardly, plows that fold the closure panels into place, glue heads that place adhesive on the closure panels and tilting weights and a vibrating table to seal the closure panels and force the container body back into the container lid.

8 Claims, 14 Drawing Figures

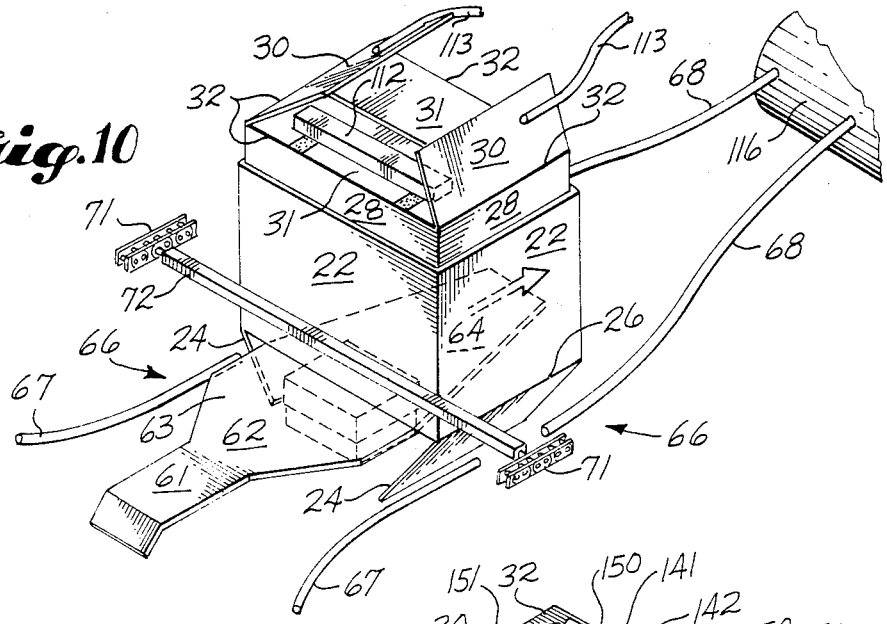
Fig. 10
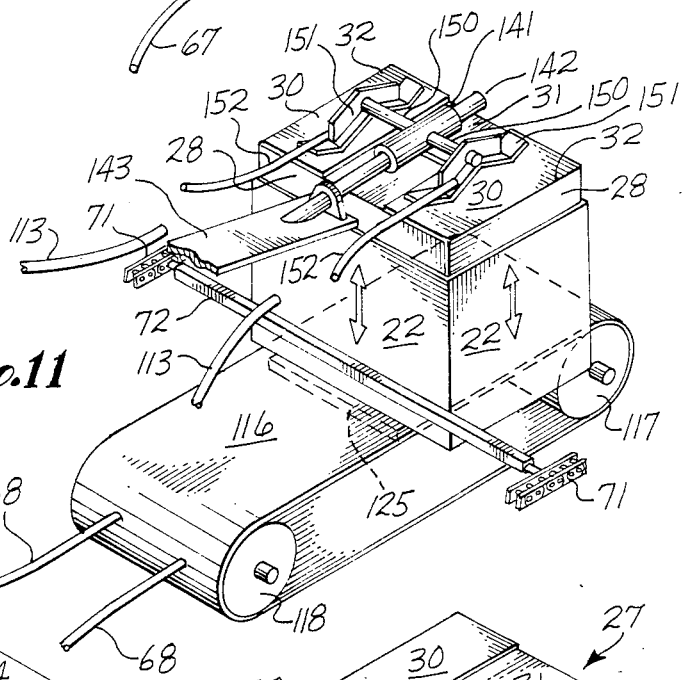
Fig. 11
Fig. 14
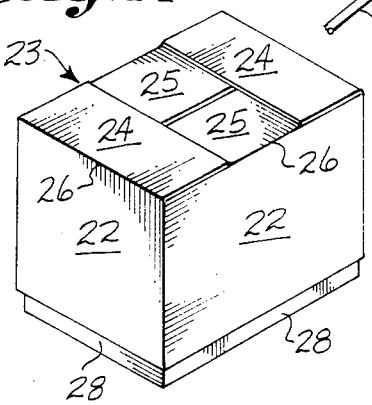
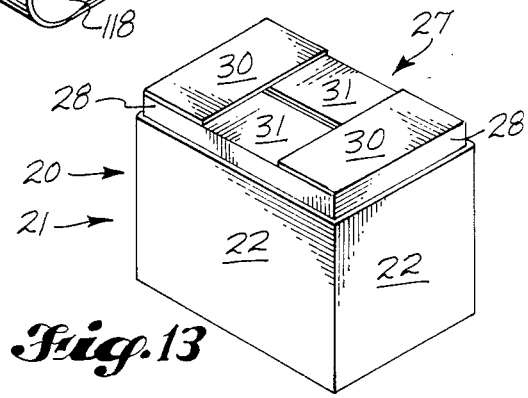
Fig. 13

CASE CLOSING APPARATUS

BACKGROUND OF THE INVENTION

Oranges typically are packed by count. The particular count in a box of oranges will depend upon the size of the orange. In a packing shed the oranges will be separated by size and the individual sizes will then be packed in a half slotted regular container. This is the body of the telescoping container having only bottom closure panels and an open top. The oranges usually will extend above the top of the container body. A second half slotted container lid will then be telescoped over the body and the body and lid will be sealed or otherwise held together.

The boxes hold approximately 38 pounds of oranges and the number of oranges will depend upon their size. Typical counts are 88 to a box or a 125 to a box. The oranges are usually packed by hand and are packed in specific patterns. In an 88 count box there will be four layers, each layer having four rows, the first and third rows having six oranges and the second and fourth rows having five oranges. The rows will alternate in each layer.

Oranges have also been packed or closed by machine. Typical machines are shown in Fuller, et al., U.S. Pat. No. 3,475,877 granted Nov. 4, 1969; Riddington, et al., U.S. Pat. No. 3,590,551 granted July 6, 1971; Voullaire, U.S. Pat. No. 3,613,330 granted Oct. 19, 1971; Cramer, et al., U.S. Pat. No. 4,386,491 granted June 7, 1983; and Certus German Offenlegungsschrift, No. DE 31 43 093 A1.

A machine for closing a telescoping container is shown in Nelson, U.S. Pat. No. 4,010,597 granted Mar. 8, 1977. A machine for assembling telescoping containers is shown in Paxton, U.S. Pat. No. 3,935,798 granted Feb. 3, 1976.

SUMMARY OF THE INVENTION

The invention will be discussed in conjunction with oranges. It will be understood that this is exemplary and other products could be packed in the container.

The inventor was asked to provide a machine which would fill a container with a correct count of oranges and which would place the oranges in the container to present the appearance of a standard pattern of hand packed oranges. The upper layer of oranges in the container must have a regular appearance.

There are count-fill machines that will place a correct number of oranges in a container. The question was how to rearrange these oranges so they would fit into the container and give the container the slightly overfilled regular appearance of a container of hand packed oranges. If the oranges were merely dumped into the container body, then they would not fit into the container and they would not have a regular hand packed appearance. No amount of shaking or vibrating of the container of oranges will rearrange the oranges or cause them to fit into the container. Consequently, filling the container body with oranges, vibrating it and then placing the telescoping top on the container will not give the desired result. There will be a large dead air space within the container which will cause the oranges and the container to be crushed when the containers are stacked.

Filling the top of the container would give a more regular pattern in the upper layer of oranges in the upright container; however, attempting to force the container body down between the container top and the oranges is, at best difficult. Again, there are the problems of the oranges not fitting in the container, of dead air space, and crushing.

He finally decided, after much work and many attempts, that the only way to accomplish the task was to place the container body inside the container top, turn the container upside down and fill the container. The top closure panels are closed and the bottom closure panels are kept open, and the container is filled with oranges from the bottom. A count-fill machine is used to place a correct number of oranges in the container. The container is vibrated during the filling operation so that the first layer in the container, the upper layer in the upright container, settles out and has a regular hand-packed appearance. The container is still overfilled with oranges.

This leads to the problem of closing the bottom closure panels. Since the container is overfilled with oranges, it is necessary to raise the bottom closure panels above the oranges and to hold them in the raised position while closing an opposed pair of the bottom closure panels. When the container body is lifted upwardly away from the top closure, more space is created within the container lid along the top closure.

The container lid is prevented from moving upwardly with the container body when the container body is pulled upwardly. Apparatus is provided to hold the container lid in place while raising the container body.

The apparatus raises the container body by grasping an opposed pair of bottom closure panels and pulling them upwardly. The other opposed pair of bottom closure panels are closed while the container body is being raised. The first opposed pair of bottom closure panels being held is then released and the panels are closed. The bottom and top closure panels then are adhered together and the container body is forced down into the container lid to present a compact, completely filled container. A tilting weight and vibrating table are provided both to adhere the bottom closure panels together and to force the container body back into the container lid. The rearrangement of the oranges along with the gentle pressure and vibration creates a closely packed and slightly overfilled container of oranges.

Each of these procedures resulted from a problem that was discovered and solved as the task went forward.

Basically the process is placing a lay-flat container body into a lay-flat container lid; opening the container; closing the top closure panels and leaving the bottom closure panels open; thereafter placing an appropriate number of oranges or other product into the container while vibrating the container; raising the container body; closing the inner bottom closure panels; placing adhesive on the outer bottom closure panels and closing them; placing a tilting weight on the bottom closure panels and vibrating the container to both adhere the bottom closure panels to each other and to force the container body down into the container lid.

The apparatus has a standard count-filler, a pair of clamps that grasp and lift the container body upwardly, plows that fold the closure panels into place, glue heads that place adhesive on the closure panels and tilting weights and a vibrating table to seal the closure panels and force the container body back into the container lid.

BRIEF DESCRIPTION OF THE DRAWINGS

FIGS. 5–11 are isometric views showing the various operations which take place within the apparatus.

FIG. 13 is an isometric view of the upside down filled and formed container.

FIG. 14 is an isometric view of the right side up filled and formed container.

DESCRIPTION OF THE PREFERRED EMBODIMENT

Figure 1:
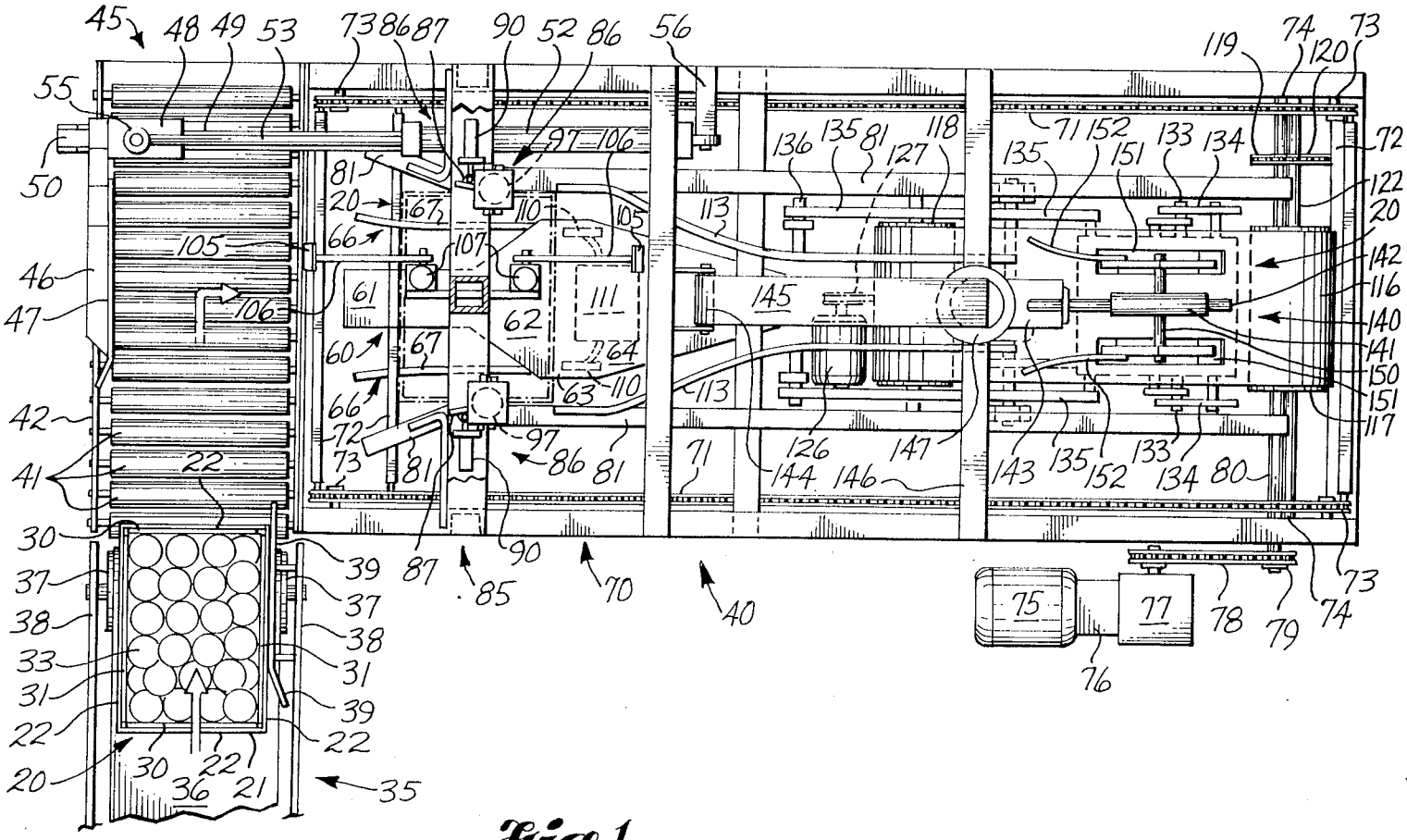
FIG. 1 is a top plan view of the apparatus for closing the containers.
Figure 2:
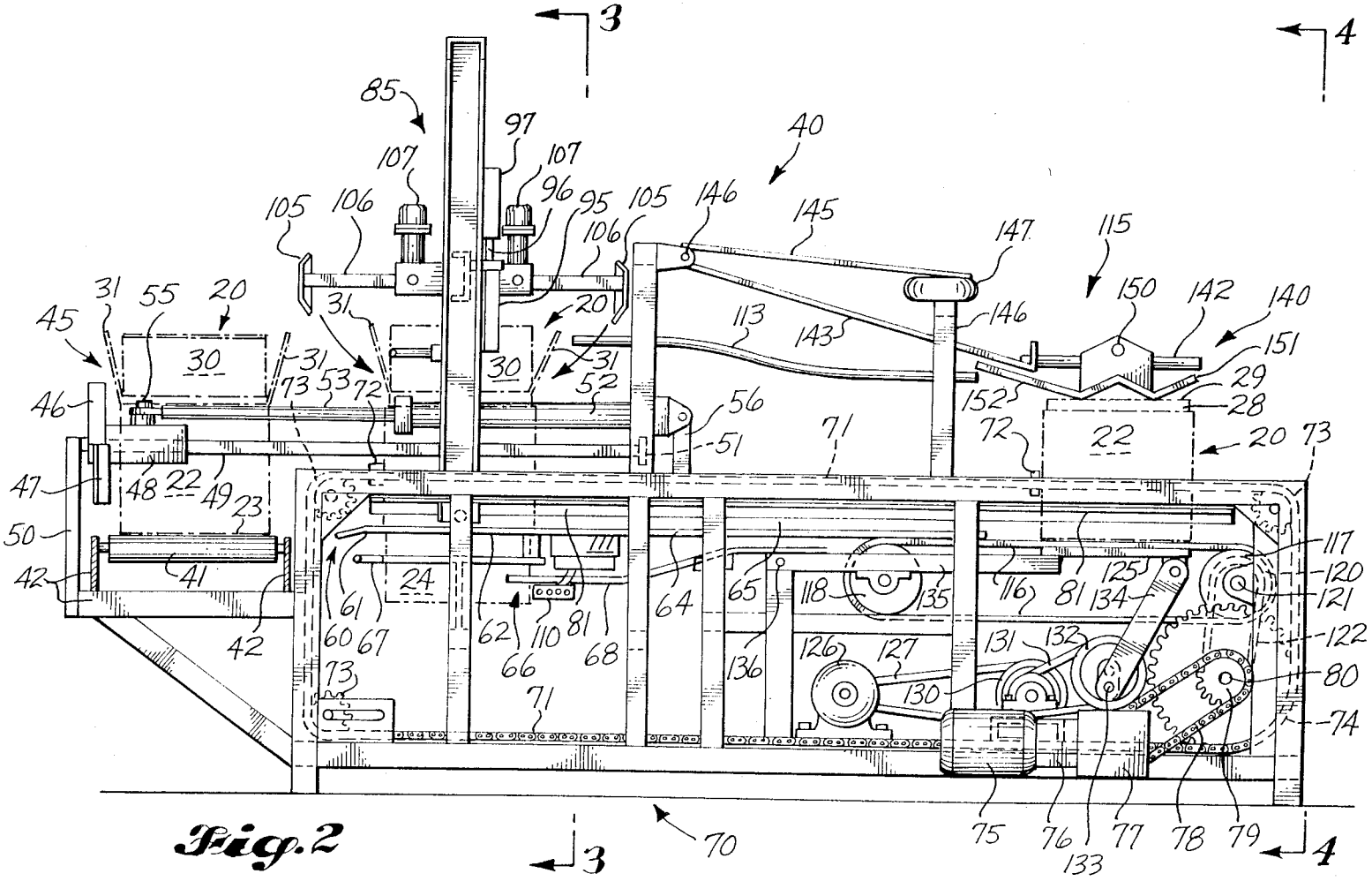
FIG. 2 is a side plan view of the apparatus shown in FIG. 1.
Figure 3:
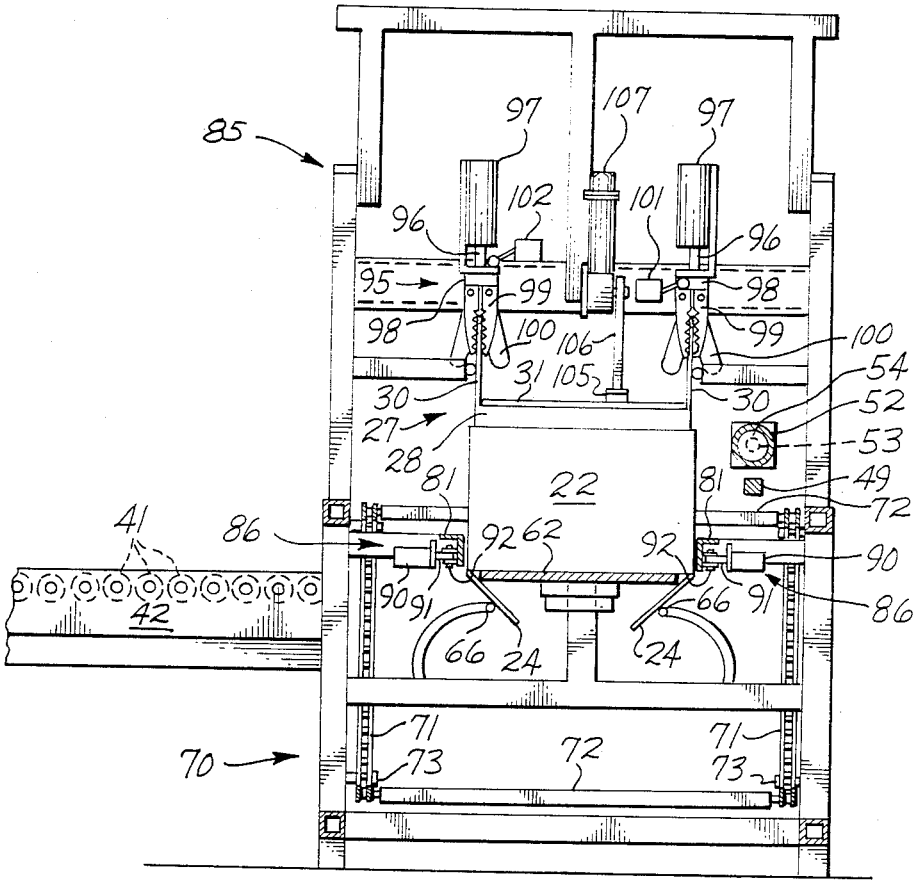
FIG. 3 is a cross-sectional view taken along line 3—3 of FIG. 2.
Figure 4:
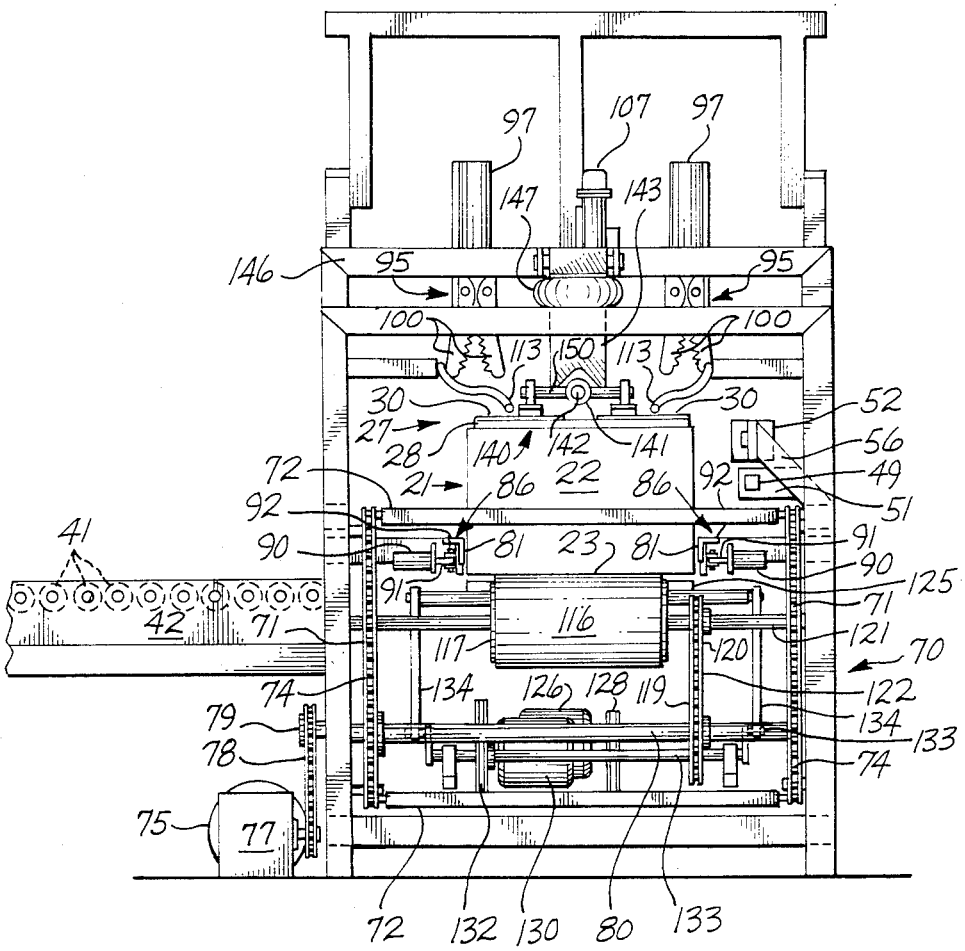
FIG. 4 is an end plan view taken along line 4—4 of FIG. 2.

The method and apparatus will be disclosed in the conjunction with the packing of citrus fruit, specifically oranges.

The container used for packing oranges is shown throughout the drawings. It is a telescoping container 20 formed of two regular half slotted containers. The container lid 21 has side walls 22 and a top closure 23. The top closure 23 is formed of minor top closure panels 24 and major top closure panels 25 which are hinged to the side walls 22 at score line 26. Telescoped within the container lid 21 is the container body 27 which has side walls 28 and a bottom closure 29. The bottom closure 29 is formed of minor bottom closure panels 30 and major bottom closure panels 31 which are hinged to side walls 28 along score line 32.

Figure 5:
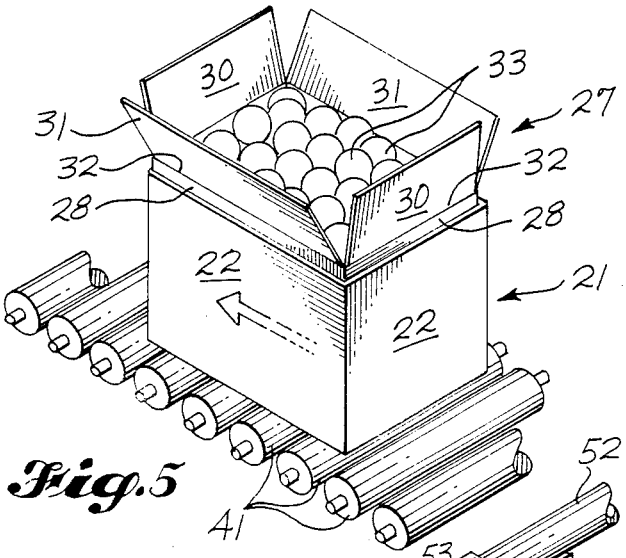

The telescoping container lid 21 is erected and the top closure flaps folded inwardly to form the top closure 23. The major top closure panels 25 are inside the minor top closure panels 24. The container lid 21 is placed upside down on a conveyor belt or conveyor rollers. The container body 27 is erected, turned upside down and placed inside the container lid 21. Alternatively, the lay-flat body may be placed in the lay-flat lid, and both may be erected together. The bottom closure panels 30 and 31 remain open as shown in FIG. 5. The upside down container is placed under a count-fill apparatus (not shown) and the appropriate number of oranges are placed in the container while the container is being vibrated. A standard count-fill apparatus and vibrator is used.

The container 20, filled with oranges 33, remains upside down during the process. It is carried to the closing apparatus 40 by infeed conveyor 35. The belt 36 and idler roll 37 of infeed conveyor 35 are shown. The idler roll 37 is mounted on frame 38. A guide 39 is also mounted on frame 38. The guide 39 aligns the container 20 as it goes toward the closing apparatus 40. The container 20 then passes to the infeed rolls 41 of the closing apparatus 40. The infeed rolls 41 are mounted for free rotation on the infeed roll frame 42.

Figure 6:
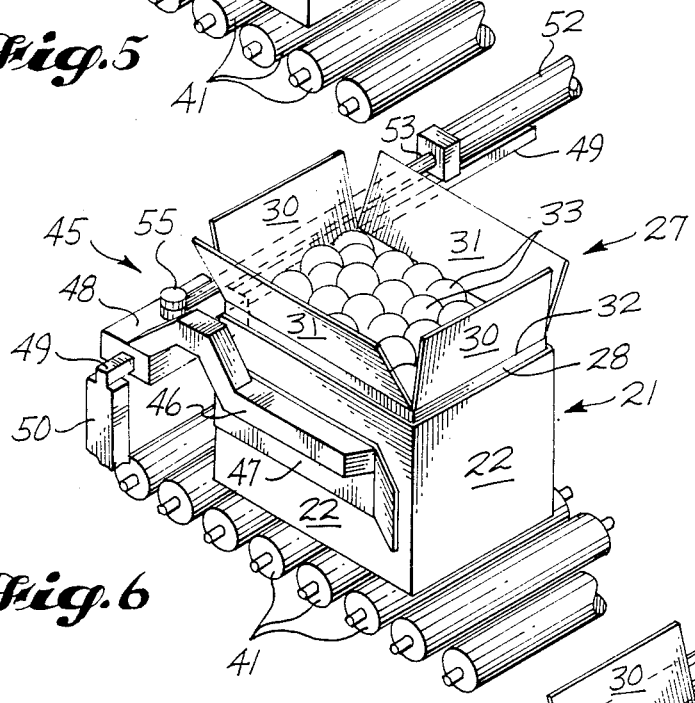
Figure 7:
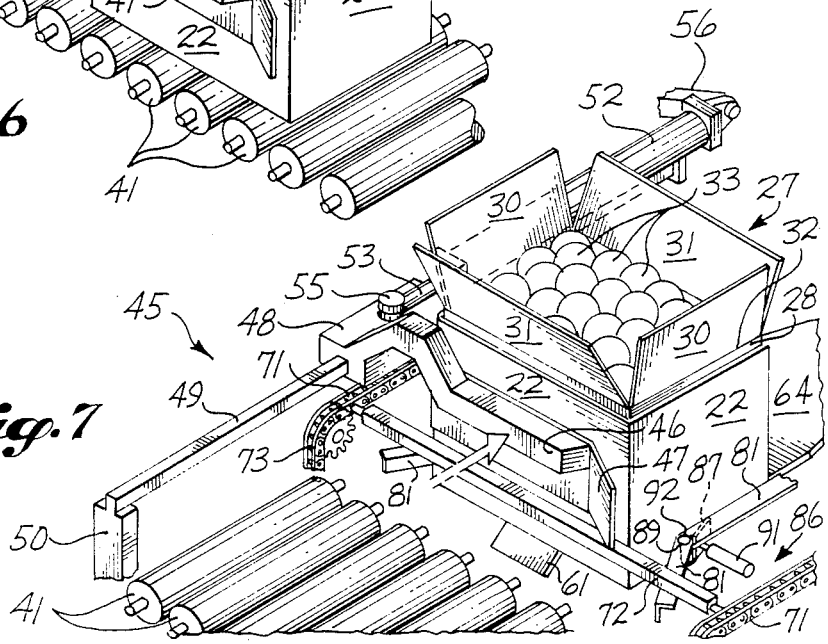

The container 20 passes over the infeed rolls 41 into the first station 45, a transfer station. The transfer station 45 has a transfer arm 46 which moves the container 20 from the rolls 41 onto a supporting plate 60. A guide plate 47, mounted on the transfer arm 46, guides the container 20 to a position in front of the transfer arm 46. The transfer arm 46 is mounted on a slide 48 and slides between an outer position at the outer side edge of the rolls 41, shown in FIG. 6, and an inner position over the supporting plate 60, shown in FIG. 7. The slide 48 slides on a bar 49 which is mounted on frame elements 50 and 51. A hydraulic cylinder 52 and arm 53 mounted on piston 54 are used to move the slide 48 between its outer and inner positions. The arm 53 is attached to the slide 48 by swivel 55, and the hydraulic cylinder 52 is attached to frame element 56.

The supporting plate 60 has a first narrow section 61, a second outwardly tapering section 62, a third wide rectangular section 63, a fourth inwardly tapering section 64, and a fifth narrow section 65.

The supporting plate 60 holds the major top closure panels 25 across the container, keeping the product within the container. The first section 61 supports the major top closure panels 25 while allowing the minor top closure panels 24 to fall free. The second section 62 continues to support the major top closure panels 25 and to separate them from the minor top closure panels 24. The third section 63 holds the minor top closure panel while adhesive is being placed on the inner face of each of the minor top closure panels 24. The fourth section 64 and the fifth section 65 allow the minor top closure panels 24 to be bent upwardly against the major top closure panels 25 and to be adhered to them while the major panels 25 continue to be supported. The lower plows 66 bear against the outer faces of the minor top closure panels 24, hold them in position for receiving glue and then bend them upwardly against the major top closure panels 25. The plows 66 extend the length of the plate 60. The plows 66 may be in sections such as the sections 67 and 68 shown.

The container 20 is moved through the apparatus 40 by a conveyor 70. The conveyor 70 has a pair of drive chains 71 on which a number of flight bars 72 are mounted. Each of the drive chains 71 are trained around a number of idler and tensioning sprockets 73 and drive sprocket 74. The drive sprockets 74 are operated by a motor 75, clutch 76, speed reducer 77, drive chain 78 and sprocket 79. The sprocket 79 is mounted on axle 80 of drive sprockets 74. The flight bars 72 push the container 20 through the apparatus discontinuously, allowing the container to remain at each station of the apparatus a predetermined amount of time. Side guides 81 guide the containers through the apparatus and align the container 20 with the apparatus.

Figure 8:
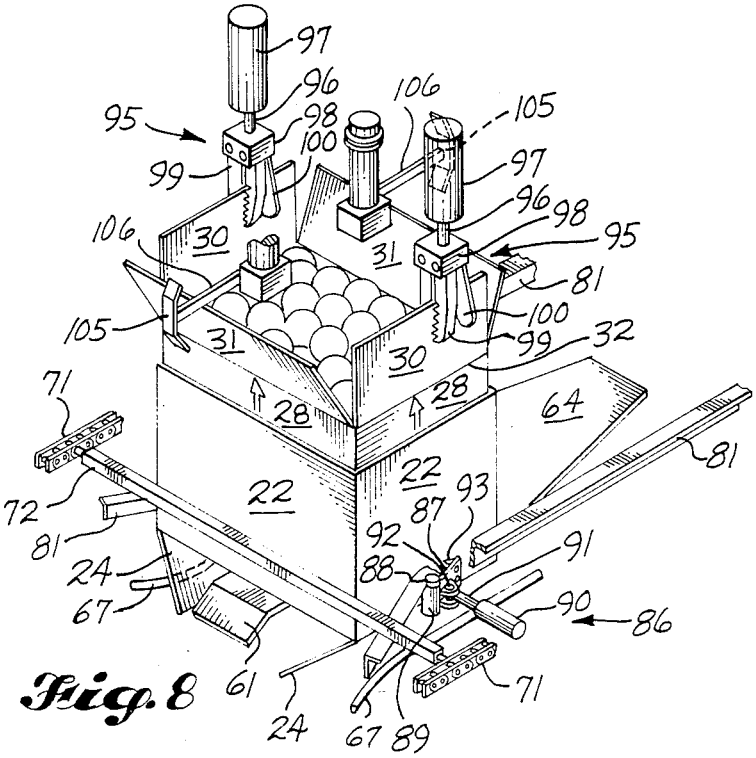
Figure 9:
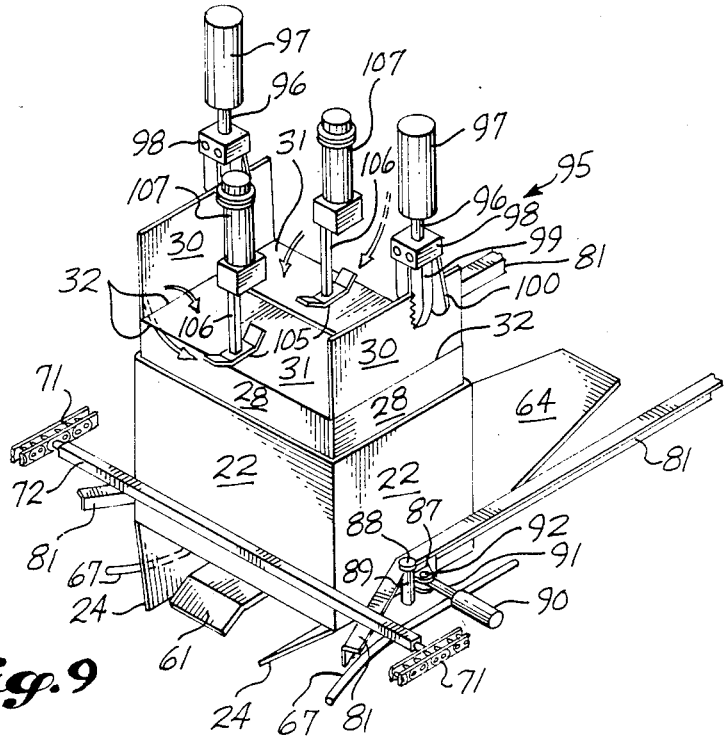
Figure 12:
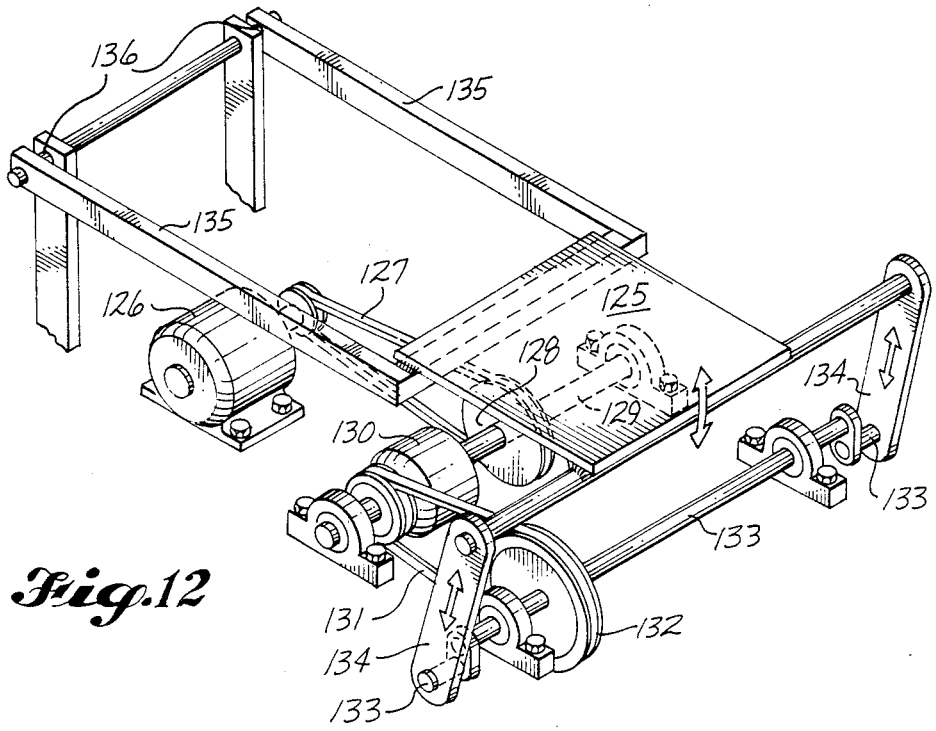
FIG. 12 is an isometric view of the vibrating mechanism.

A number of operations take place at the second station 85 of the apparatus. These operations are shown in FIGS. 8–9. The container lid 21 is held on the supporting plate 60 while the container body 27 is lifted upwardly a predetermined distance. The hinge score lines 32 between the bottom closure panels 30 and 31 and the container body side walls 28 are above the contained fruit 33 when the container body has been raised. The major bottom closure panels 31 are also bent downwardly over the fruit 33.

The container lid 21 is held in place on the plate 60 by the holding devices 86 when the container body is being raised. The holding device 86 has a plate 87 which is pivoted at its leading edge 88. Each pivot 89 is adjacent the path of travel of adjacent container side wall 22. The inner face of plate 87 has a number of pins or needles 93 which hold the container lid 21 in place when the container body 27 is lifted. The pins 93 on the inner surface of the plates 87 should be no longer than the thickness of the corrugated board forming the container lid 21 so that the container body 27 is not held in place also. The plate 87 is pivoted from its outer position shown in FIG. 8 to its inner position shown in FIG. 9 by a hydraulic cylinder 90 and piston and arm 91. The arm 91 is attached to the plate 87 by a swivel 92. The movement of the container 20 into the station trips either a limit switch or a photocell which operates the cylinder 90. The plate 87 is pivoted into its inner position holding the container lid 21 in place.

The container body 27 is pulled upwardly by clamps 95 which grasp the minor bottom closure panels 30 and pull the panels upwardly. The clamps 95 are moved hydraulically between a lower position shown in FIG. 8 and an upper position shown in FIG. 9. Each clamp 95 is attached by an arm 96 to a piston within hydraulic cylinder 97. The cylinders 97 are mounted on the frame. The same switch that operates the cylinders 90 to close the holding plates 87 also operates cylinder 96 to lower the clamps 95. Each of the clamps 95 has an operating element 98 which opens and closes the clamping members 99. Guides 100 guide the panels 30 into the clamping members 99. Closing switch 101 senses when the clamps 95 are in their lowermost position and signals operating element 98 to close the clamping members 99 onto the panels 30. A time delay operates the cylinder 97 to raise the clamps 95 upwardly after the clamping members 99 are closed and are holding the panels 30.

The major panels 31 are closed as the container body 27 moves upwardly. The major bottom closure panels 31 are closed by a pair of hydraulically operated plows 105. Each of the plows 105 is attached by an arm 106 to a hydraulic cylinder 107.. The cylinders 107 are mounted on the frame. The arms 106 are normally in a horizontal position and are swiveled downwardly to a vertical position by the cylinder 107. The pressure in the cylinder is low so the downward travel of the plows 105 will stop if the closure panels 31 should meet resistance from the contained fruit 33. They will fold the panels 31 into their horizontal position only after the score line 32 and the closure panels have been raised above the fruit 33 as shown in FIG. 9. The cylinders 107 are also operated by the time delay switch that operates the cylinder 97 to raise the clamps 905. Cylinders 97 and 107 operate at the same time. An opening switch 102 senses when the clamps 95 reach their uppermost position and causes the operating elements 98 to open the clamping members 99, the cylinders 90 to retract plates 87 and the cylinders 107 to retract the plows 105, releasing the container.

The container 20 is now moved through the remaining stations in the machine. In these stations, adhesive is applied to the closure panels and the minor closure panels are folded onto and glued to the major closure panels. Adhesive is applied to the minor top closure panels 24 by adhesive applicators 110 and adhesive reservoir 111 and to the major bottom closure panels 31 by adhesive applicator 112. The minor bottom closure panels 30 are folded downwardly onto the major bottom closure panels 31 by upper plows 113, and the minor top closure panels 24 are folded upwardly against the major top closure panels 25 by lower plows 66.

The container 20 is moved to a vibrating and sealing station 115. At this station, the minor closure panels are glued to the major closure panels and the container body 27 is pushed downwardly into the container lid 21. The station 115 may be either one or two stations. One station is shown, but the vibrating station may be separate from the sealing station. It may be before or after the sealing station.

The station 115 has a belt 116 which receives the container 20 from the plate 60, moves the container 20 through the station and supports the container in the station. The belt 116 is trained around a drive roll 117 and an idler roll 118. The drive roll 117 is also driven by motor 75. A drive sprocket 119 is mounted on the axle 80 of the drive sprockets 74. A second sprocket 120 is mounted on shaft 121 of drive roll 117 and in line with sprocket 119. A drive chain 121 is trained around sprockets 119 and 120.

A vibrating plate 125 is operated by motor 126. The motor 126 drives a belt 127. The belt 127 is trained around a sheave 128 on shaft 129. A clutch 130 is attached to the shaft 129. The other side of the clutch 130 drives a belt 131 which is trained around a sheave 132 on eccentric shaft 133. Arms 134 are mounted on eccentric shaft 133 and are attached to the trailing end of vibrating plate 125. Arms 135 are attached to the leading end of vibrating plate 125. The arms 135 are pivoted at 136. The pivot 136 is mounted on the frame. The vibrating plate 125 is underneath the belt 116. Movement of a container into station 115 trips a limit switch or photocell and causes the clutch 130 to engage, vibrating the plate 125.

A weight 140 is placed on the minor bottom closure panels 30. The weight 140 swivels in both directions to compensate for any tilting of the container bottom closure 29. The weight 140 has a sleeve 141 which swivels on a central bar 142. The bar 142 is above and substantially parallel to the plate 60, and extends longitudinally and centrally of plate 60 and vibrating plate 125. The bar 142 is attached to arm 143 which is pivoted to the frame at 144. The arm 143 pivots upwardly when a container 20 enters the sealing station 115, and pivots downwardly when no container is in the station 115. The amount of downward movement is determined by the upper arm 145 attached to arm 143. The arm 145 is fixed to arm 143 and extends from pivot 144 rearwardly over the frame element 146 and the air bag 147 attached to the frame element 146. The air bag 147 cushions the downward movement of the arms 147 and 145 and attached weight 140.

The weight 140 has bars 150 which are mounted on sleeve 141 and extend transversely of plate 125. A pair of W-shaped weights 151 are mounted on and swivel on the bars 150. Each of the weights 151 rests on the container closure panels at two points. An upwardly extending guide 152 forms the leading surface of each of the weights 151. This construction allows a weight 151 to be on the outer face of each of the minor bottom closure panels 30 and remain on them while the panels are glued and the container body 27 is being forced into the container lid 21.

The container 20 moves into the station 115 and the weights 151 rest on the minor closure panels 30 until the glue sets. The vibration unit is started by a timer and the weights 151 now push the container body 27 downwardly into the lid 21 as the container 20 vibrates. The vibration stops and the conveyor 70 moves the container 20 from the apparatus 40.

I claim:

1. A method of closing and forming a telescoped container filled with a product, said telescoped container having inner and outer telescoped members, said inner member having side panels and closure panels extending upwardly from said side panels, said closure panels being joined to said side panels by score lines located below the level of said product, comprising, supporting said telescoped container, grasping a pair of said closure panels and raising said inner member upwardly until said score lines are above said product, closing the remaining closure panels of said inner member, releasing said pair of closure panels, closing said pair of closure panels, securing said pair of closure panels and remaining closure panels together, vibrating said telescoped container while forcing said inner member into said outer member.

2. The method of claim 1 in which said inner member has two pair of opposed closure panels.

3. The method of claim 1 in which said closure panels are glued together and a weight is used both to secure the panels together and to force said inner member into said outer member.

4. Apparatus for closing and forming a telescoped container filled with a product, said telescoped container having inner and outer telescoped members, said inner member having side panels and closure panels extending upwardly from said side panels, said closure panels being joined to said side panels by score lines located below the level of said product, comprising means for supporting said telescoped container, means for grasping a pair of said closure panels and raising said inner container upwardly until said score lines are above said product, means for closing the remaining closure panels of said inner member, means for releasing said pair of closure panels, means for closing said pair of closure panels, means for securing said pair of closure panels and remaining closure panels together, means for vibrating said telescoped container, and means for forcing said inner member into said outer member.

5. The apparatus of claim 4 in which said grasping means comprise a pair of clamps which grasp said closure panels and a means for lifting said clamps.

6. The apparatus of claim 4 in which said closure means for closing the remaining closure panels comprise a pair of hydraulically operated plows which are operated under pressure low enough to stop said plows if said panels encounter said product.

7. The apparatus of claim 4 in which the means for securing said closure flaps and for forcing said inner member into said outer member comprise a tilting weight which tilts in both the transverse and longitudinal direction of said machine whereby said weight will rest on said container.

8. The apparatus of claim 4 further comprising means for conveying said container through said apparatus.

* * * * *